US006946386B2

(12) United States Patent
Steinlesberger et al.

(10) Patent No.: US 6,946,386 B2
(45) Date of Patent: Sep. 20, 2005

(54) PROCESS FOR PRODUCING ULTRATHIN HOMOGENOUS METAL LAYERS

(75) Inventors: Gernot Steinlesberger, Munich (DE); Manfred Engelhardt, Feldkirchen-Westerham (DE); Eugen Unger, Augsburg (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/854,759

(22) Filed: May 25, 2004

(65) Prior Publication Data

US 2004/0253806 A1 Dec. 16, 2004

(30) Foreign Application Priority Data

May 26, 2003 (DE) ..... 103 23 905

(51) Int. Cl.[7] ..... H01L 21/4763
(52) U.S. Cl. ..... 438/622; 438/637; 438/687
(58) Field of Search ..... 438/622, 623, 438/625, 629, 637, 641, 642, 687

(56) References Cited

U.S. PATENT DOCUMENTS 6,511,912 B1 * 1/2003 Chopra et al. ..... 438/674

* cited by examiner

*Primary Examiner*—Phuc T. Dang
(74) *Attorney, Agent, or Firm*—Darby & Darby

(57) ABSTRACT

A method of forming an ultrathin homogenous metal layer that serves as base metallization for formation of contact locations and/or contact pads and/or wirings of an integrated electronic component. The method includes the steps of depositing a first metal layer on a substrate at least in regions, and producing a second metal layer on the first metal layer at least in regions, component(s) of the second metal layer have a more positive redox potential than component(s) of the first metal layer, wherein ultrathin homogenous deposition of the second metal layer is effected by wet-chemical, current-free, electrochemical redox processes by element exchange from one or more metal salts as oxidant with at least a top metal atomic layer of the first metal layer as reductant.

8 Claims, 2 Drawing Sheets

PROCESS FOR PRODUCING ULTRATHIN HOMOGENOUS METAL LAYERS

CROSS-REFERENCE TO RELATED APPLICATION

This application claims priority to German Patent Application No. 103 23 905.7-33, which was filed on May 26, 2003, and is incorporated herein by reference in its entirety.

FIELD OF THE INVENTION

The invention relates to a process for forming an ultrathin homogenous metal layer which is able in particular to serve as base metallization for the formation of contact locations and/or contact pads and/or wirings on an integrated electronic component, such as microchips or microarrays wherein a first metal layer 20 is deposited on a substrate 10 at least in regions, and then a second metal layer 30 is produced on the first metal layer at least in regions, the component(s) of the second metal layer 30 having a more positive redox potential than the component(s) of the first metal layer 20, and the ultrathin homogenous deposition of the second metal layer 30 being effected by means of wet-chemical, current-free, electrochemical redox processes, optionally under simultaneous activation of the surface of the first metal layer 20, by element exchange from one or more metal salts as oxidant with at least the top metal atomic layer of the first metal layer 20 as reductant.

BACKGROUND OF THE INVENTION

The introduction of copper as a metallization material in integrated circuits, i.e., for forming corresponding contact locations and/or contact pads and/or rewirings during microchip fabrication, has brought with it a number of changes to the process technology used in the various wiring planes. The method which is customarily used at present for the fabrication of copper tracks is what is known as the "damascene" technology. Unlike when patterning metal layers by dry-etching processes, in this technology the trench and contact hole structures are firstly transferred into the insulator and then filled with the desired metal, usually copper. For this deposition process, an electrochemical deposition, i.e., electroplating, is preferred, on account of the better filling properties and on account of its microstructural and electrical advantages. However, for electroplating of this type, an electrically conductive base metallization (seed layer) must first be applied to the corresponding substrate. The resistivity and the morphology of the base metallization determine the properties of the copper layer which is subsequently electrochemically deposited in order to form corresponding contact locations and/or contact pads and/or rewirings. To improve the bonding and to prevent copper from diffusing into the insulator, with resulting transistor failures, it is necessary to construct a barrier layer between the base metallization and the insulator (for example silicon dioxide or dielectrics with a lower dielectric constant).

Barrier layer and base metallization are usually produced in two independent steps by means of physical vapor deposition or chemical vapor deposition (CVD). Special physical or chemical vapor deposition processes have been developed for the deposition of, for example, copper base metallizations which have to be homogenous and free of defects. However, a general problem encountered with CVD methods for metal deposition is that the deposited metal layers contain certain amounts of foreign atoms (i.e., precursor impurities). This leads to an undesirable increase in the resistivity of the base metallization.

Moreover, ever decreasing feature sizes mean that it is necessary to reduce the layer thicknesses of all the metal layers as part of the fabrication of integrated electronic components or microchips of this type. However, in terms of the process development and optimization, this generally entails high levels of outlay. In addition, smaller feature sizes and therefore higher aspect ratios (trench height to trench width) give rise to further problems, such as for example incomplete side wall coverage in sputtering processes. Deposition of thin metal layers which are just a few metal atomic layers thick is a possible but very expensive technique for future technology generations.

One method of solving the above-described problems is, for example, to introduce a further process step, in which an inhomogeneous base metallization is optimized (seed repair). However, an additional process step of this type is always expensive.

SUMMARY OF THE INVENTION

Therefore, it is an object of the present invention, as part of the fabrication of integrated electronic components, such as for example microchips, to provide for the targeted production of ultrathin homogenous metal layers, in particular which serve as base metallization for the subsequent electrochemical metal deposition in order to fill trenches or holes so as to form corresponding contact locations and/or contact pads.

This object is achieved by the embodiments described in the claims.

The present invention provides a process for forming an ultrathin homogenous metal layer which is able in particular to serve as base metallization for the formation of contact locations and/or contact pads and/or wirings on an integrated electronic component, such as a microchip, wherein a first metal layer 20 is deposited on a substrate 10 at least in regions, and then a second metal layer 30 is produced on the first metal layer at least in regions, the component(s) of the second metal layer 30 having a more positive redox potential than the component(s) of the first metal layer 20, and the ultrathin homogenous deposition of the second metal layer 30 being effected by means of wet-chemical, current-free, electrochemical redox processes, optionally under simultaneous activation of the surface of the first metal layer 20, by element exchange from one or more metal salts as oxidant with at least the top metal atomic layer of the first metal layer 20 as reductant. The process according to the invention constitutes a general simplification of the production of ultrathin homogenous metal layers.

In the process according to the invention, the first metal layer itself serves as reductant. This first metal layer is oxidized in at least the top metal atomic layer by (a) respective precursor compound(s), i.e., (an) oxidant(s), e.g., metal salt(s), of the second metal layer to be deposited, wherein the respective ions generated from the first metal layer transfer to solution, and simultaneous deposition of the second metal layer from the respective precursor compound (s) takes place. In order to enable the above redox process to take place in the process of the invention, usually, the surface of the first metal layer is activated simultaneously. This can, for example, be accomplished when removing a passivating oxide layer on the first metal layer. In the process of the invention, such an activation can, for example, be realized by treatment with hydrofluoric acid (HF) which is present with respective concentration besides the above-mentioned precursor compound(s) of the second metal layer in the solution for the wet-chemical, current-free, electrochemical redox processes according to the process of the present invention.

The wet-chemical deposition of the second metal layer requires a chemical potential drop between a metal salt of the metal which forms the second metal layer and the metal of the previously applied first metal layer, which serves as a barrier layer. Given a sufficient potential drop, in which the interplay of kinetics and thermodynamics is a significant factor which influences this redox reaction, the baser metal of the barrier layer is oxidized while the metal cations of the metal salt of the metal forming the second metal layer are reduced and thereby form an ultrathin metal layer, second metal layer, on the first metal layer, with at least the top metal atomic layer of the first metal layer being exchanged.

As part of the process according to the invention, the first metal layer is preferably composed of at least one component selected from tantalum, titanium or aluminum or alloys thereof with, for example, magnesium, it being possible for it to be produced by means of physical vapor deposition or chemical vapor deposition (CVD). However, it is also possible to use other elements or alloys, provided that they perform a good barrier function and have a correspondingly more negative redox potential than the metal which forms the second metal layer.

The process according to the invention is based on the production of an ultrathin metal layer or base metallization by element exchange by means of a wet-chemical, current-free, electrochemical redox process. The second metal layer is formed by the top metal atomic layers of the first metal layer, which serves as a barrier layer, being exchanged with metal atoms of the metal which forms the second metal layer. Therefore, the separate deposition of two metal layers (diffusion barrier and base metallization) which is customarily provided is replaced by just a deposition of the barrier layer and a subsequent wet-chemical exchange reaction leading to the formation of the ultrathin, homogenous second metal layer as the actual base metallization. The process according to the invention advantageously does not require an additional seed repair process step. Therefore, according to the invention conventional deposition of a base metallization is replaced by an inexpensive wet-chemical process.

The first metal layer, which acts as a barrier layer, may, for example, be applied in a thickness of from 5 nm to 100 nm, preferably from 10 to 50 nm and more preferably from 10 to 20 nm.

The second metal layer, which serves as a base metallization for the subsequent electrochemical deposition of metal in order to fill the trenches and holes so as to form contact locations and/or contact pads on, for example, a microchip, preferably comprises copper, silver, gold, platinum or nickel or corresponding alloys thereof. The second metal layer may be continuous or in the form of islands. In the context of the process according to the invention, the metal salts and electrolyte compositions that are customarily employed for the abovementioned metals can be used for the wet-chemical deposition of this second metal layer. The second metal layer may be deposited in such a manner that it is just one or a few metal atomic layers thick. It may therefore be formed, for example, with a thickness of from 0.5 nm to 10 nm, in particular 1 nm to 10 nm.

There are no specific restrictions on the substrate materials. By way of example, it is possible to use the dielectrics which are customarily used as part of microchip fabrication, such as for example $SiO_2$. The substrates may be unpatterned. However, they are usually patterned with the trenches or holes that are customary in the context of microchip fabrication, for example, by means of corresponding lift-off techniques and/or lithography techniques.

In one preferred embodiment of the process according to the invention, first of all a first metal layer of tantalum, which serves as a barrier layer, and then a second metal layer of copper, which can serve in particular as a base metallization and is formed on the first metal layer, are produced. In this case, the base metallization is produced by exchanging Ta atoms from the top atomic layers for copper atoms which together form a base metallization which is suitable for the subsequent electrochemical deposition of corresponding contact locations and/or contact pads and/or wirings.

According to the present invention, by way of example, to form the second metal layer first of all 20% strength hydrofluoric acid (HF) can be mixed with 20 g/l of $CuSO_4.5H_2O$ at room temperature, with which a substrate with a barrier layer which has already been deposited on it is then treated for a few seconds until a dark color appears (copper deposition).

After in a first step, first of all, by way of example, a tantalum layer has been applied to a patterned substrate by means of PVD or CVD processes, the wet-chemical process as part of the process according to the invention can be divided into the following reaction steps:

First of all, the native, passivating tantalum oxide layer is removed using hydrofluoric acid in accordance with the following reaction equations:

$$Ta_2O_5+10HF+2F^- \rightarrow 5H_2O+2TaF_6^-$$

$$Ta_2O_5+10HF+4F^- \rightarrow 5H_2O+2TaF_7^{2-}$$

(both reactions are in equilibrium)

In the next step, according to the invention copper is generated:

$$2Ta+5Cu^{2+} \rightarrow 2Ta^{5+}+5Cu$$

(redox potentials: $Ta \rightarrow Ta_2O_5$: −0.75 V and $Cu \rightarrow Cu^{2+}$: +0.34 V)

The advantages of the process according to the invention lie in the saving on the costs of expensive process steps and the elimination of additional process steps for optimizing a defective base metallization. The process according to the invention can advantageously be used in particular to produce very thin base metallizations for metallization systems which are subsequently to be applied. The thickness of the barrier or the barrier to base metallization ratio can be adjusted by means of the concentration of the corresponding solutions in the wet-chemical process and the parameters of the chemical reaction, such as time and temperature. Furthermore, the process according to the invention promotes bonding between the first metal layer and the second metal layer, which is of benefit to the reliability of metallization systems and therefore to the service life of corresponding products which result from the process according to the invention, such as microchips or microarrays.

DETAILED DESCRIPTION OF THE PREFERRED MODE OF THE INVENTION

Figure 1A:
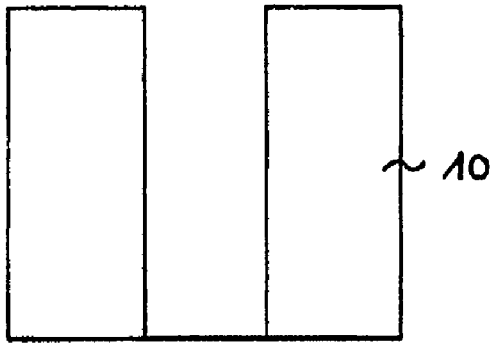
FIG. 1*a* diagrammatically depicts a substrate with trench structure that is used in the process according to the invention.
Figure 1B:
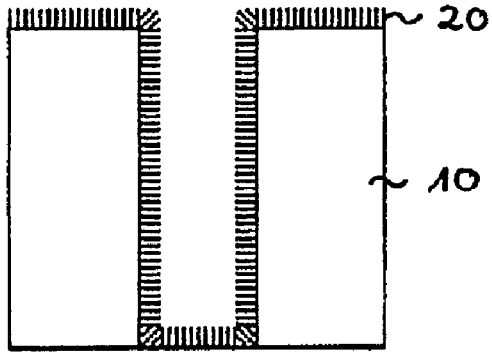
FIG. 1*b* diagrammatically depicts the structure from FIG. 1*a* to which the first metal layer has been applied.
Figure 1C:
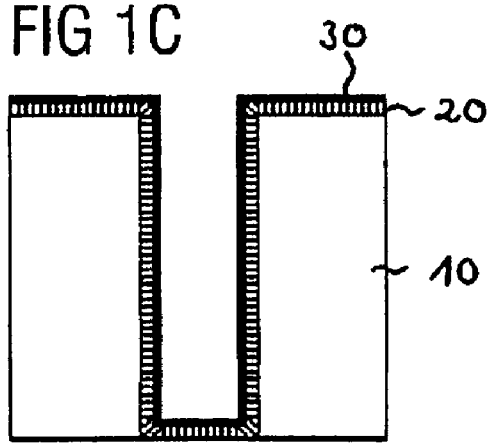
FIG. 1*c* diagrammatically depicts the substrate from FIG. 1*b* in which a homogenous ultrathin second metal layer has been produced on the first metal layer.

FIG. 1*a* diagrammatically depicts a substrate 10 having a trench or contact hole structure. The substrate 10 used in the process according to the invention may, for example, be an insulator (for example silicon dioxide or dielectrics with a relatively low dielectric constant) as part of an integrated electronic component, such as a microchip or microarray. FIG. 1*b* diagrammatically depicts the substrate 10 with the first metal layer 20, which serves as a barrier layer, deposited on it. This first metal layer 20, according to the invention, is composed of at least one metal, such as for example tantalum, titanium of aluminum, preferably tantalum, and can be produced by means of physical vapor deposition or chemical vapor deposition (CVD). FIG. 1*c* diagrammatically depicts the substrate 10 with the deposited first metal layer 20 and the second metal layer 30 which has been applied thereto by wet-chemical means. The second metal layer 30 may, for example, be composed of copper, silver, gold, platinum or nickel, preferably copper, and may be continuous or in island form.

Figure 2:
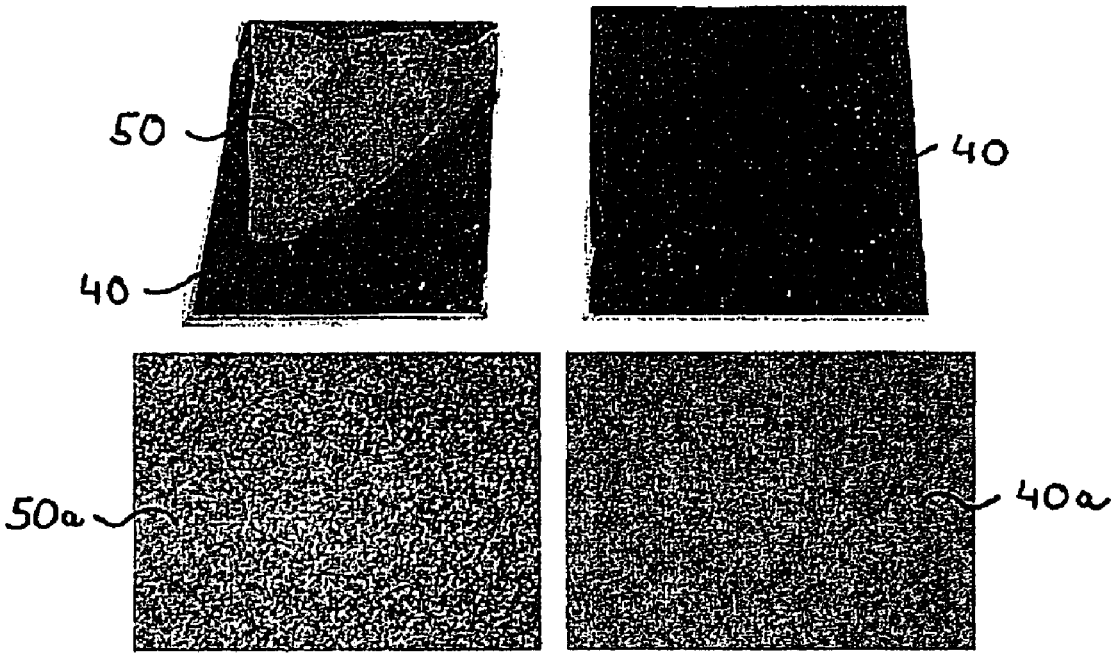
FIG. 2 shows, in the top row, optical microscope images of a substrate ($SiO_2$) provided with a tantalum barrier layer before and after production of a thin copper layer and, in the lower row, enlarged scanning electron microscope images of the corresponding tantalum and copper surfaces.

FIG. 2 shows optical microscope images of substrates which have been coated in according to the invention with a tantalum barrier layer 40 and of a copper layer 50 which has been deposited on part of the substrates in island form. The figure also shows enlarged scanning electron microscope images of the tantalum layer 40*a* and the copper layer 50*a*. The different components of the first metal layer 20 and the second metal layer 30 can be distinguished from one another on the basis of their different surface morphologies.

The process according to the invention enables the complex process steps of separate base metallization on, for example, integrated electronic components which are otherwise customary to be avoided. The process according to the invention is not restricted only to applications in the context of the metallization of patterned substrates, but rather it can be used and expanded for all applications in which thin metal layers are used for further processes, but in particular electrochemical deposition of various metals.

What is claimed is:

1. A method of forming an ultrathin homogenous metal layer that serves as base metallization for formation of contact locations and/or contact pads and/or wirings of an integrated electronic component, comprising the steps of:

depositing a first metal layer on a substrate at least in regions; and producing a second metal layer on the first metal layer at least in regions, component(s) of the second metal layer have a more positive redox potential than component(s) of the first metal layer;

wherein ultrathin homogenous deposition of the second metal layer is effected by wet-chemical, current-free, electrochemical redox processes by element exchange from one or more metal salts as oxidant with at least a top metal atomic layer of the first metal layer as reductant.

2. The method as claimed in claim 1, wherein the first metal layer is composed of at least one component selected from the group consisting of tantalum, titanium, and aluminum.

3. The method as claimed in claim 1, wherein the second layer is composed of at least one component selected from the group consisting of copper, silver, gold, platinum, and nickel.

4. The process as claimed in claim 1, wherein the first metal layer is composed of tantalum and the second metal layer is composed of copper.

5. The process as claimed in claim 1, wherein the first metal layer is deposited by physical vapor deposition (PVD) or chemical vapor deposition (CVD).

6. The process as claimed in claim 1, wherein the first metal layer has a thickness of from 5 nm to 100 mm.

7. The process as claimed in claim 1, wherein the second metal layer has a thickness of from 0.5 nm to 10 nm.

8. The process as claimed in claim 1, wherein the ultrathin homogenous deposition of the second metal layer is effected by the wet-chemical, current-free, electrochemical redox processes during simultaneous activation of the surface of the first metal layer.

* * * * *